United States Patent [19]

Blacker, Jr. et al.

[11] Patent Number: 4,795,391

[45] Date of Patent: Jan. 3, 1989

[54] MEANS AND METHOD OF FORMING ALIGNED APERTURES IN ELECTRON GUNS

[75] Inventors: Allen P. Blacker, Jr.; Khem K. S. Garewal, both of Hoffman Estates, Ill.

[73] Assignee: Zenith Electronics Corporation, Glenview, Ill.

[21] Appl. No.: 67,676

[22] Filed: Jun. 26, 1987

[51] Int. Cl.[4] ..... H01J 9/02

[52] U.S. Cl. ..... 445/36; 219/69 M; 445/66

[58] Field of Search ..... 445/36, 66, 68; 219/69 M, 69 R; 204/129.55, 129.7

[56] References Cited

U.S. PATENT DOCUMENTS 3,410,980 11/1968 Gugger et al. ..... 219/69 M 4,071,932 2/1978 Standaart ..... 445/36 X

FOREIGN PATENT DOCUMENTS 45541 4/1977 Japan ..... 219/69 M 40834 3/1982 Japan ..... 445/36

*Primary Examiner*—Kenneth J. Ramsey

[57] ABSTRACT

A method of forming aligned apertures in the electrode plates of an electron gun which includes a plurality of electrode plates at least one of which is preapertured and at least another is unapertured. A boring tool, such as an electric-discharge machine, is sized to fit snugly within the aperture in the preapertured electrode plate. The boring tool is inserted through the aperture in the preapertured electrode plate whereby the plate aligns the tool in a position of concentricity. The tool is activated to form a precision concentric aperture in the unapertured electrode plate.

27 Claims, 3 Drawing Sheets

MEANS AND METHOD OF FORMING ALIGNED APERTURES IN ELECTRON GUNS

FIELD OF THE INVENTION

This invention generally relates to electron guns for cathode ray tubes and, particularly, to a method and system for obtaining very accurate aperture alignment during electron gun fabrication.

BACKGROUND OF THE INVENTION

It is well-known to those skilled in the art that electron guns are constructed in a variety of configurations, depending upon the application thereof. However, certain features are common to most electron guns, one of which is the existence of a plurality of axially disposed apertures disposed in electrode plates or grids to accommodate passage of the electron beam.

Structurally, a typical electron gun includes an annular cylinder or like configuration having a cathode at one end, a G1 electrode mounted forwardly of the cathode and a G2 electrode positioned forwardly of the G1 electrode. Both the G1 and G2 electrodes are provided with central apertures aligned with the electron emitting face of the cathode, the apertures providing openings to permit passage of the electron beam. The operating efficiency of an electron gun is affected by proper alignment of the G1 and G2 apertures. The more precise this alignment, the better the operating characteristics of the gun.

An example of a high-resolution color television electron gun is shown in U. S. Pat. No. 4,469,987 to Blacker et al, dated Sept. 4, 1984, and assigned to the assignee of this invention. The electron gun shown therein includes a G1 electrode, a G2 electrode, a G3 electrode and main focus electrodes. Each electrode is electrically isolated from the others. In addition, this patent shows an electron gun wherein a tetrode section has three coplanar beams created by three discrete cathodes. Therefore, each of the G1, G2, G3 and main focus electrodes include three apertures.

Regardless of whether the electron gun includes a single beam construction or a three-beam array, heretofore, the most prominent method of obtaining aperture alignment through the series of electrode plates has been to employ some form or another of a mandrel. Examples of such "mandrelling" of the electrode plates for aperture alignment are shown in U. S. Pat. Nos. 3,500,520 and 3,510,926 to Oess, dated March 17, 1970 and May 12, 1970, respectively.

Although aperture aligning mandrels can be machined to very accurate dimensions, such as on a lathe, theoretically precision alignment of the electrode plate apertures should be achieved. However, in actual practice, this is not always true. One problem resides in the simple fact of "mechanical spring back." In other words, the electrode plates conventionally are fabricated of metallic material and the mandrel actually is forced through at least some of the apertured plates relative to other plates. Upon removal of the mandrel, the mechanical nature of the metallic plates tend to move back to their original condition, even if slightly.

Another problem occurs in the heating and cooling cycles required during manufacture of the electron gun and/or the cathode ray tube. This heating and cooling of the metallic electrode plates also results in misalignment. For instance, the electrode plates may be anchored in a glass bead for permanent alignment. The mandrel is inserted through the apertures in the electrode plates and maintained in position during the heating step required to render the glass beads at least semi-molten. This may be on the order of 1,000 degrees Celsius. When the mandrel is removed, and the components are allowed to cool, misalignment occurs. It simply is not practical for any acceptable production rate to allow the mandrel to remain within the assembly during the cool-down period. Production efficiency and cost prohibits the use of a sufficient number of fixtures to allow such procedures to be performed.

OBJECTS OF THE INVENTION

Accordingly, it is a general object of this invention to provide a method of obtaining precise alignment of the apertures in the electrode plates or grids of a typical electron gun.

Another object of this invention is to provide a method of obtaining precise alignment of the apertures of the G1 and G2 electrodes in an electron gun.

A further object of the invention is to provide a method of obtaining precise alignment of the apertures in the electrode plates of an electron gun after the electrode plates already have been permanently anchored to their support structure for assembly in the electron gun.

Other objects, features and advantages of the invention will be apparent from the following detailed description taken in connection with the accompanying drawings.

BRIEF DESCRIPTION OF THE DRAWINGS

The features of the present invention which are believed to be novel are set forth with particularity in the appended claims. The invention, together with objects and advantages thereof, may best be understood, however, by reference to the following description taken in conjunction with the accompanying drawings, in the several figures of which like reference numerals identify like elements, and in which:

DETAILED DESCRIPTION OF THE PREFERRED EMBODIMENT

Figure 1:
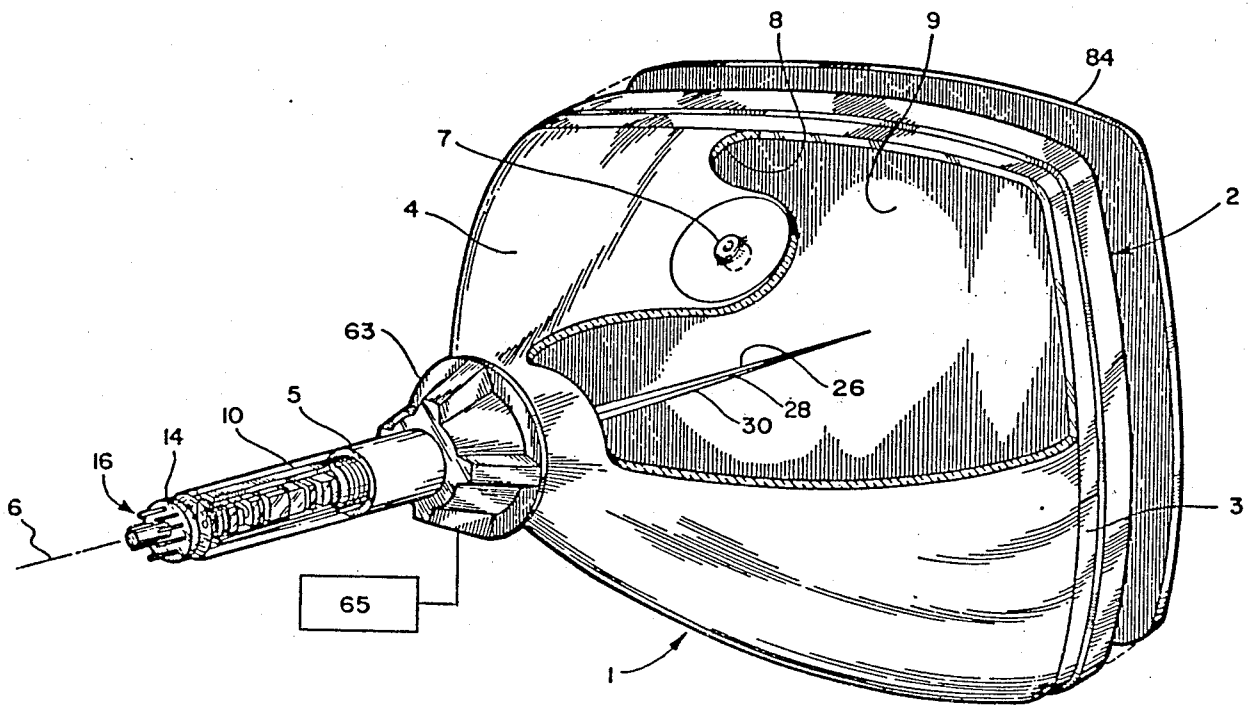
FIG. 1 is a perspective view of a cathode ray tube, partially cut away to show internal details.

Referring to the drawings in greater detail, and first to FIG. 1, there is depicted a high-brightness cathode ray imaging tube configured according to the principles of the invention. The evacuated glass envelope of tube 1 essentially comprises a face panel 2 having a rearwardly extending flange 3, a funnel 4, a neck 5, all aligned on the tube central axis 6. Funnel 4 has an anode button 7 therethrough for introducing a high voltage into the envelope. Anode button 7 makes contact with a conductive coating 8 deposited on the inner surface of funnel 4. The inner surface of face panel 2 has deposited thereon an unsegmented cathodoluminescent screen 9 for producing a monochromatic image under electron bombardment. An "unsegmented" screen is defined as one comprising an homogeneous deposit of phosphor(s); that is, one having no discrete arrays of multicolor groups in the form of dots or stripes.

Figure 2:
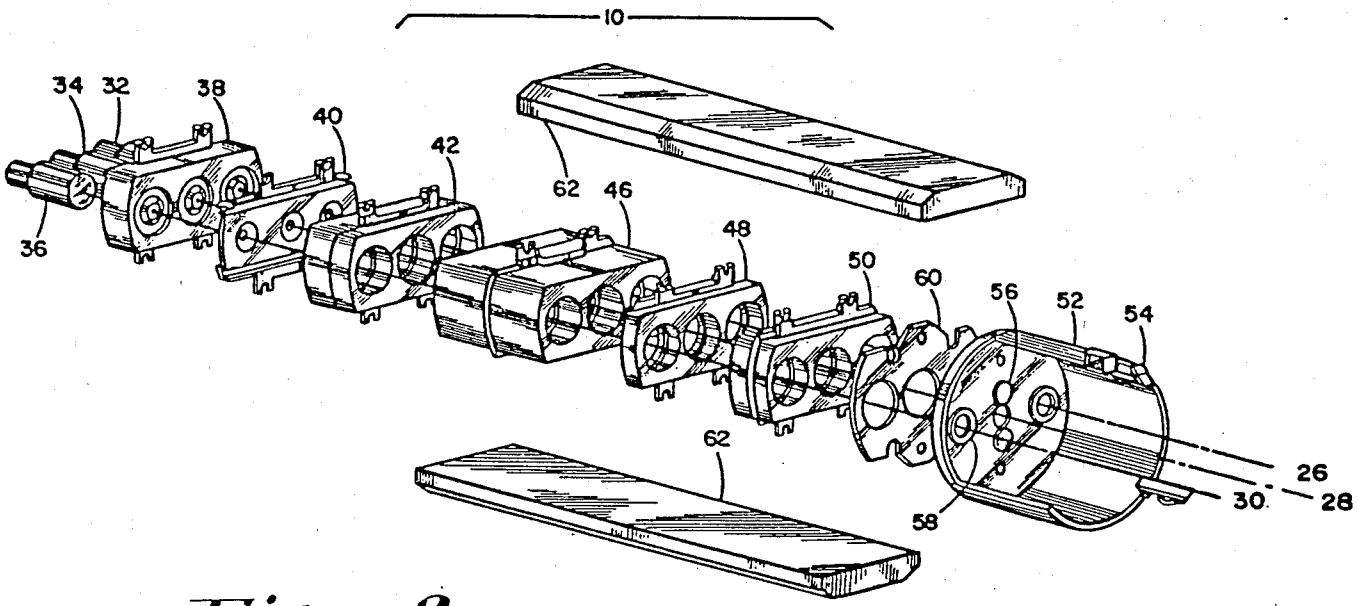
FIG. 2 is an exploded perspective view of the components of a high-resolution color television electron gun.
Figure 3:
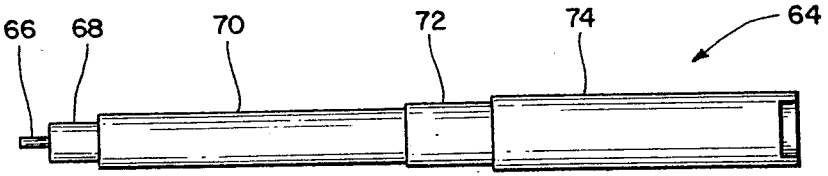
FIG. 3 is an elevational view of a typical mandrel component for aligning the apertures in the electrode plates, according to conventional procedures of the prior art.

Disposed within neck 5 of tube 1 is a high-resolution, in-line color television electron gun according to an embodiment of the invention, which is shown in detail in FIGS. 2 and 3. Electron gun 10 is depicted as being a "unitized" gun; that is, a gun in which common structures are used for different gun parts. Electron gun 10 according to this embodiment of the invention provides three horizontally oriented, coplanar, in-line beams, each of which is formed, shaped and directed to activate the cathodoluminescent screen 9 of cathode ray tube 1. The beams are converged into substantial coincidence on screen 9.

Electron gun 10 is illustrated as having a central axis 12 which is substantially congruent with the central axis 6 of tube 1. A cathode ray tube base 14 provides a plurality of lead-in pins 16 for introduction into the envelope of tube 1 the video signals, as well as certain voltages for beam forming, focusing, and accelerating. A power supply 18, depicted schematically, provides a predetermined pattern of applied voltages including a relatively low, relatively intermediate, and relatively high voltages for application to selected grids of tetrode section 24 and to the electrodes of main focus lens section 44 of gun 10 for establishing beam focusing and accelerating electrostatic fields. Relatively low and relatively intermediate voltages from power supply 18 are applied to the electron gun through a plurality of external leads 20 routed through the lead-in pins 16 of base 14. The relatively high applied voltage is routed to the anode button 7 of tube 1 through a high-voltage conductor 21. The operating signals, and the low and intermediate applied voltages, are conveyed to the several electrodes of gun 10 within the glass envelope by means of internal electrical leads; typical leads are shown by 22.

The tetrode section 24 of gun 10 includes associated cathode means and grid means for forming each of the beams. Three separate beam cross-overs (not shown), are generated, one for each of the three coplanar beams 26, 28 and 30 that lie mainly on three axes 11, 12 and 13 in the deflection plane of tube 1. The four elements of the tetrode section 24 may comprise, by way of example: (1) three discrete cathodes 32, 34 and 36, one for each beam, and supported by a common cathode support 37; (2) a unitized, three-apertured first grid (G1) 38 partially enclosing cathodes 32, 34 and 36; (3) a unitized, three-apertured disc-type second grid (G2) 40; and (4) a unitized, three-apertured grid (G3) 42. Each of the three apertures is in axial alignment with one of the three beams 26, 28 and 30.

The three beam cross-overs are imaged on screen 9 of cathode ray tube 1 by main focus lens 44. In the illustrated embodiment, the main focus lens electrodes for the three beams 26, 28 and 30 are unitized and constituted as the "upper end" section, or section facing toward the tube screen. The main focus lens 44 comprises at least a first, second, and third electrode, and in this embodiment of the invention, lens 44 is shown as including common main focus electrode 42, and common main focus electrodes 46, 48 and 50. Each of these unitized electrodes is electrically isolated from the others. Main focus lens 44 is a low-aberration, low-magnification, extended field lens comprising first, second, third and fourth electrode means 42, 46, 48 and 50 for receiving a predetermined pattern of applied voltages including a relatively intermediate applied voltage applied to the first and third electrode means 42 and 48, a relatively low applied voltage applied to second electrode means 46, and a relatively high applied voltage to the fourth electrode means 50. Main focus lens 44 establishes an electrostatic field having an axial potential distribution which decreases from a relatively intermediate axial potential to a relatively low axial potential, and then increases to a relatively high axial potential.

The last in the series of elements is a support cup 52 that provides a mounting base for the three contact springs 54 which center the forward end of the gun in the neck of the cathode ray tube. Also, through contact with the electrically conductive coating 8 of tube 1, contact springs 54 conduct high voltage through support cup 52 to electrode 50. Located within the cavity formed by the support cup, and adjacent to the apertures from which the three electron beams 26, 28 and 30 emerge, are enhancer means 56 and shunt means 58. Support cup 52 is aligned and bonded to electrode 50 in precise registration by means of a carrier plate 60 which lies between the two elements.

In the unitized, in-line gun, unitized grids and electrodes 38, 40, 42, 46, 48 and 50 have on each side thereof at least one pair of widely spaced, relatively narrow claws embedded at spaced points on wide glass beads 62. This structural concept does not constitute, per se, an aspect of this invention but is described and claimed in U. S. Pat. No. 4,032,811 issued to the assignee of this invention. Other details of the cathode ray tube and electron gun of FIGS. 1 and 2 can be derived from the aforementioned U. S. Pat. No. 4,469,987 which is incorporated herein by reference.

FIG. 3 shows a typical mandrel, generally designated 64, which might be used for aligning the apertures in electrode plates G1 (38), G2 (40) and G3 (42), as well as G4 main focus electrodes 46, 48 and 50. With the three apertured grids described in relation to the electron gun of FIGS. 1 and 2, three such mandrels would be employed in a common fixture. The electrodes of the electron gun would be aligned and positioned by passing the mandrels through the apertures in the electrodes and placing spacing washers on the mandrel between the successive electrodes. The mandrels would be inserted from the end opposite electrodes 32, 34 and 36. It can be seen that mandrel 64 includes a forward portion 66 for insertion into the aperture of G1 grid or electrode plate 38, a portion 68 for insertion into an aperture in the G2 grid or electrode plate 40, a portion 70 for insertion into the G3 grid or electrode plate 42, and portions 72 and 74 for insertion through the apertures in main focus electrodes 46–50. As stated above, the mandrels would be inserted into the electrodes prior to anchoring the electrodes to glass beads 62. Each of the electrodes include tabs 76 which penetrate the glass beads when the glass beads are heated to at least a semi-molten state, requiring a temperature on the order of 1,000 degrees Celsius. Because of simple or rational production limitations, the mandrels must be removed prior to cooling and that is when the problems of misalignment occur, as described above.

Figure 4:
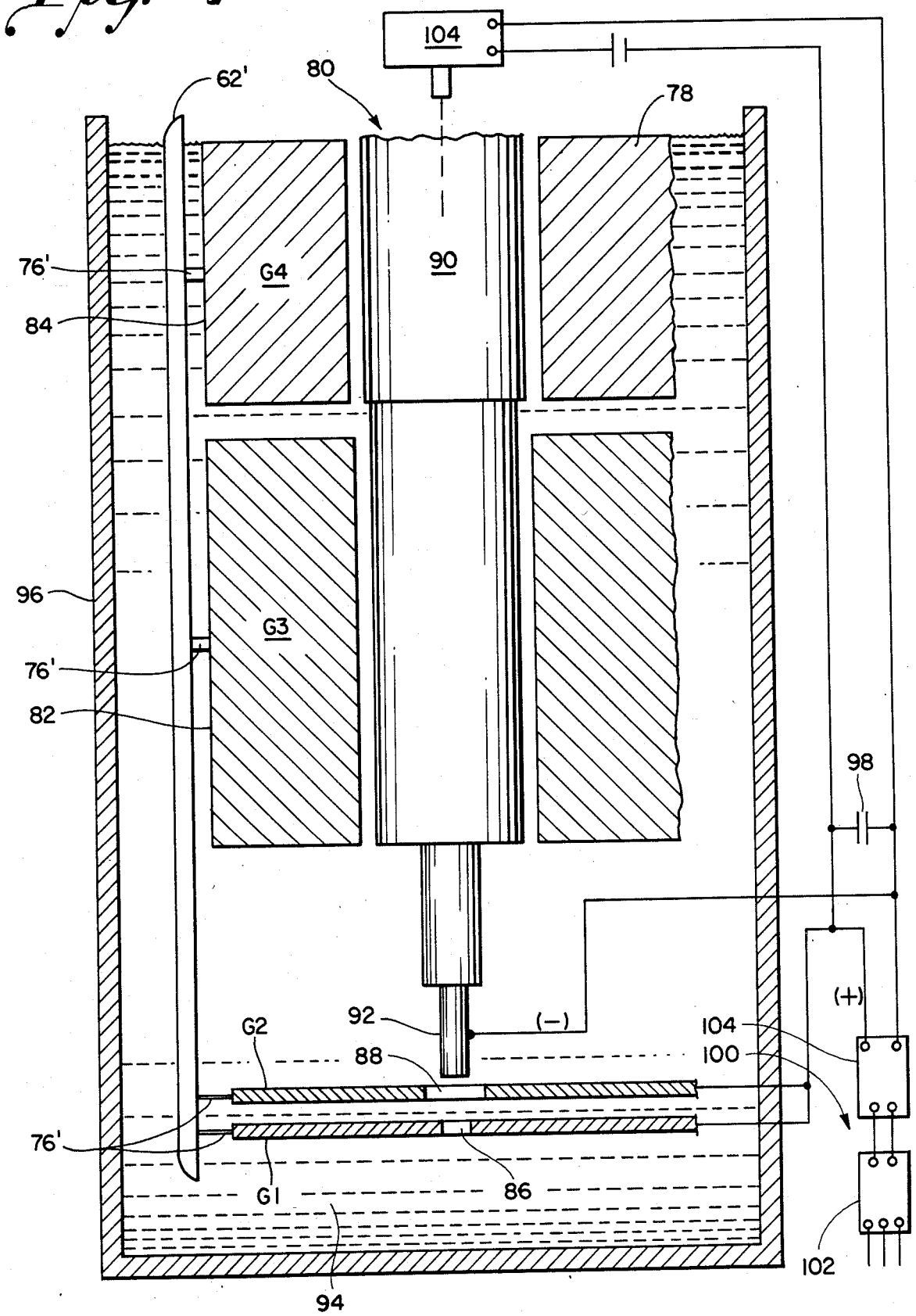
FIG. 4 is a somewhat schematic illustration of a setup for carrying out the method of the invention for forming aligned apertures in the electrode plates of an electron gun.

FIG. 4 represents a schematic illustration or set-up of a system and method for carrying out the invention of forming aligned apertures in the electrode plates of the electron gun. It should be understood that the relative dimensions are not scaled to the components of FIG. 2, for instance, in order to facilitate the illustration. In addition, it can be seen by fragmented line 78 that the set-up shown may be enlarged to accommodate electrode plates each having three apertures.

To this end, it can be seen that a G1 electrode plate, a G2 electrode plate, a G3 electrode plate and a G4 electrode plate all are anchored to a glass bead 62' by tabs 76'. OF course, in a complete set-up, a comparable glass bead would be disposed at the opposite side of the three-aperture assembly.

Generally, the invention contemplates a method of forming aligned apertures in the electrode plates wherein at least one of the electrode plates is preapertured for guiding a boring tool, generally designated 80, which effectively forms apertures in the unapertured electrode plates. In the illustration of FIG. 4, electrode plates G3 and G4 are preapertured with apertures 82 and 84, respectively. These apertures serve to align and guide boring tool 80 in a position of concentricity, whereby activation of the boring tool effectively forms precision concentric apertures 86 and 88 in electrode plates G1 and G2, respectively. It is significant to note that all of the electrode plates G1-G2 have been permanently anchored to glass beads 62' prior to performing the aperturing method of this invention. Therefore, all of the misalignment problems caused by the heating and cooling cycles described above are eliminated.

Although boring tool 80 can take various forms, such as laser means or the like, the preferred embodiment contemplates providing a boring tool in the form of an electric discharge machine. The boring tool itself includes a body portion 90 sized to fit snugly within apertures 82, 84 of the preapertured electrode plates G3, G4 so that the boring tool is precisely aligned in a position of concentricity. In essence, body portion 90 forms outside guide means for the tool. The boring tool includes a distal terminal portion 92 of the electric discharge machine which effectively forms apertures 86 and 88 in unapertured electrode plates G1, G2. An appropriate support structure or fixture (not shown) mounts boring tool 80 for linear movement as described below.

More particularly, the electric discharge machine is of basic construction and is operative on the principle of erosion of metals by spark discharges. The spark is a transient electric discharge through the space between two charged electrodes, which are the tool (i.e., terminal 92) and the workpiece (electrode plates G1 and G2). The discharge occurs when the potential difference between the tool and the electrode plates is sufficiently large to cause a breakdown in a medium 94 which is called the dielectric fluid, usually a hydrocarbon, to procure an electrically conductive spark channel. The dielectric fluid 94 is contained in a reservoir 96 within which the assembly of the electrode plates, anchored to glass bead 62', is immersed.

Breakdown potential is established by connecting the two electrodes (92 and 86, 88) to the terminals of a capacitor 98 charged from a power source, generally designated 100. The power source includes a rectifier 102 and a current control 104.

The spacing between tool 92 and electrode plates G1 and G2 is important and, therefore, feed of the tool is controlled by a servo-control 106. In other words, after aperture 88 is formed in electrode plate G2, the tool is moved progressively toward electrode plate G1. It can be seen that terminal 92 has stepped outside dimensions corresponding to the different sized apertures 86 and 88.

Dielectric fluid 94 also functions as a cooling medium and for tearing away particles produced by the electric discharge. The discharge can be repeated rapidly, and each time a minute amount of material is removed from electrode plates G2 and G1 to form apertures 88 and 86, respectively. The electrode plates typically are fabricated of metal, such as 304 Stainless Steel.

The rate of metal removal depends mostly on the average current of the discharge circuit. It also is a function of the electrode characteristics, the electrical parameters, and the nature of the dielectric fluid. Since higher rates produce rougher surfaces, it would be desirable to operate the tool at a lower rate to provide a finished surface about apertures 86, 88. The response of the materials to the process depends mostly on their thermal properties. Thermal capacity and conductivity, as well as latent heats of melting and vaporization are important. Hardness and strength do not necessarily have significant effect on metal-removal rates. The process is applicable to all materials which are sufficiently good conductors of electricity. Therefore, since electrode plates G1, G2 conventionally are fabricated of stainless steel, the electric discharge machining process contemplated by this invention is quite efficient.

From the foregoing, it can be seen that a new and improved method of forming aligned apertures in the electrode plates of an electron gu has been provided and which obviates many of the problems of conventional mandrelling processes. Forming the aligned apertures in the electrode plates after the electrode plates already have been permanently anchored in their assembly for positioning within the electron gun affords advantages not heretofore available in the prior art.

It is recognized that numerous changes in the described embodiments of the invention will be apparent to those skilled in the art without departing from its true spirit and scope. The invention is to be limited only as defined in the claims.

What is claimed is:

1. In a method of forming aligned apertures in the electrode plates of an electron gun which includes a plurality of electrode plates at least one of which is preapertured and at least another which is unapertured, comprising the steps of:

providing a boring tool sized to fit snugly within the aperture in the preapertured electrode plate;

inserting the boring tool through the aperture in the preapertured electrode plate whereby the plate aligns the tool in a position of concentricity; and activating the boring tool to form a precision concentric aperture in the unapertured electrode plate.

2. The method of claim 1 wherein the electron gun includes a plurality of preapertured electrode plates, and including the step of inserting the boring tool seriatim through the apertures in the preapertured electrode plates.

3. The method of claim 1 wherein the electron gun includes a plurality of unapertured electrode plates, and including the step of progressively forming apertures in the unapertured electrode plates.

4. The method of claim 3 wherein the electron gun includes a plurality of preapertured electrode plates, and including the step of inserting the boring tool seriatim through the apertures in the preapertured electrode plates.

5. The method of claim 1 wherein the electron gun includes a plurality of preapertured electrode plates having apertures of progressively smaller sizes in a direction toward the unapertured plate, and including providing the boring tool with complementary outside guide means for fitting snugly within the different sized apertures in the preapertured electrode plates.

6. The method of claim 1 wherein said boring tool is provided as an electric-discharge machine, and said last-named step includes electrically activating the electric-discharge machine.

7. The method of claim 6 wherein the electron gun includes a plurality of unapertured electrode plates, and including the step of progressively moving the electric-discharge machine seriatim in a direction toward the unapertured plates as an aperture is formed in the unapertured plate nearest the electric-discharge machine.

8. The method of claim 1 including the step of permanently anchoring the electrode plates to a support means on the electron gun prior to inserting the boring tool through the plate.

9. The method of claim 8 wherein the preapertured electrode plate is permanently anchored to glass bead means on the electron gun.

10. In a method of forming aligned apertures in the electrode plates of an electron gun which includes a plurality of preapertured electrode plates and a plurality of unapertured electrode plates, comprising the steps of:

providing an electric-discharge machine having a tool sized to fit snugly within the apertures in the preapertured electrode plates;

inserting the electric-discharge tool seriatim through the apertures in the preapertured electrode plates whereby the plates align the tool in a position of concentricity; and electrically activating the electric-discharge tool to progressively form precision concentric apertures in the unapertured electrode plates.

11. The method of claim 10 wherein said preapertured electrode plates have apertures of progressively smaller sizes in a direction toward the unapertured plates, and including providing the electric-discharge tool with complementary outside guide means for fitting snugly within the different size apertures in the preapertured electrode plates.

12. The method of claim 10 wherein the electric discharge tool is moved seriatim in a direction toward the unapertured plate as an aperture is formed in the unapertured plate nearest the electric-discharge tool.

13. The method of claim 12 wherein said preapertured electrode plates have apertures of progressively smaller sizes in a direction toward the unapertured plates, and including providing the electric-discharge tool with complementary outside guide means for fitting snugly within the different sized apertures in the preapertured electrode plates.

14. The method of claim 10, including the step of permanently anchoring the electrode plate to a support means on the electron gun prior to inserting the boring tool through the plate.

15. The method of claim 14 wherein the preapertured electrode plate is permanently anchored to glass bead means on the electron gun.

16. In a method of forming aligned apertures in the electrode plates of an electron gun which includes a plurality of preapertured electrode plates having apertures of progressively smaller sizes in a direction toward a plurality of unapertured electrode plates, comprising the steps of:

permanently anchoring the electrode plates to support means on the electron gun;

providing an electric-discharge machine having a discharging tool sized to fit snugly within the different sized apertures in the preapertured electrode plates;

inserting the electric-discharge tool seriatim through the apertures in the preapertured electrode plates whereby the plates align the tool in a position of concentricity;

activating the electric-discharge tool to form a concentric aperture in one of the unapertured electrode plates; and moving the electric-discharge tool seriatim in a direction toward the unapertured plates as an aperture is formed in the one unapertured plate nearest the electric-discharge tool.

17. The method of claim 16 wherein the preapertured electrode plate is permanently anchored to glass bead means on the electron gun.

18. In a method of forming aligned apertures in the electrode plates of an electron gun which includes a plurality of electrode plates at least one of which is preapertured and at least another is unapertured, comprising the steps of:

permanently anchoring the preapertured electrode plate to a support means on the electron gun;

providing a boring tool sized to fit snugly within the aperture in the preapertured electrode plate;

inserting the boring tool through the aperture in the preapertured electrode plate whereby the plate aligns the tool in a position of concentricity; and activating the boring tool to form a precision concentric aperture in the unapertured electrode plate.

19. The method of claim 18 wherein the electron gun includes a plurality of preapertured electrode plates, and including tee step of inserting the boring tool seriatim through the apertures in the preapertured electrode plates.

20. The method of claim 19 wherein the electron gun includes a plurality of unapertured electrode plates, and including the step of progressively forming apertures in the unapertured electrode plates.

21. The method of claim 8 wherein the electron gun includes a plurality of preapertured electrode plates, and including the step of inserting the boring tool seriatim through the apertures in the preapertured electrode plates.

22. The method of claim 18 wherein said boring tool is provided as an electric-discharge machine, and said last-named step includes electrically activating the electric-discharge machine.

23. The method of claim 22 wherein the electron gun includes a plurality of unapertured electrode plates, and including the step of progressively moving the electric-discharge machine seriatim in a direction toward the unapertured plates as an aperture is formed in the unapertured plate nearest the electric-discharge machine.

24. The method of claim 18 wherein the preapertured electrode plate is permanently anchored to glass bead means on the electron gun.

25. A system for forming aligned apertures in the electrode plates of an electron gun which includes a plurality of electrode plates at least one of which is preapertured and at least another is unapertured, comprising:

means for permanently anchoring the electrode plates to a support means on the electron gun;

a boring tool sized to fit snugly within the aperture in the preapertured electrode plate whereby the plate aligns the tool in a position of concentricity; and means for activating the boring tool to form a precision concentric aperture in the unapertured electrode plate.

26. The system of claim 25 wherein said boring tool comprises an electric-discharge machine and said activating means includes means for electrically activating the electric-discharge machine.

27. The system of claim 25 wherein the electron gun includes a plurality of preapertured electrode plates having apertures of progressively smaller sizes in a direction toward the unapertured plate, said boring tool including complementary outside guide means for fitting snugly within the different sized apertures in the preapertured electrode plates.

* * * * *